United States Patent [19]

Ohnaka et al.

[11] 4,343,277

[45] Aug. 10, 1982

[54] THROTTLE VALVE OPENING CONTROLLER

[75] Inventors: Hidemi Ohnaka, Susono; Norikatsu Ishikawa, Mishima, both of Japan

[73] Assignee: Toyota Jidosha Kogyo Kabushiki Kaisha, Toyota, Japan

[21] Appl. No.: 164,272

[22] Filed: Jun. 30, 1980

[30] Foreign Application Priority Data

Jul. 20, 1979 [JP] Japan ..... 54/92929

[51] Int. Cl.[3] ..... F02D 11/08; F02D 9/08; F02M 19/12

[52] U.S. Cl. ..... 123/389; 123/396

[58] Field of Search ..... 123/328, 389, 378, 396, 123/340, DIG. 11, 198 D, 198 DB, 198 DC

[56] References Cited

U.S. PATENT DOCUMENTS

| | | | |
|---|---|---|---|
| 3,752,141 | 8/1973 | Charron et al. | 123/389 |
| 4,168,680 | 9/1979 | Kawai et al. | 123/389 |
| 4,171,686 | 10/1979 | Chenet | 123/396 |

*Primary Examiner*—Raymond A. Nelli

*Attorney, Agent, or Firm*—Stevens, Davis, Miller & Mosher

[57] ABSTRACT

A throttle valve opening controller for applying varying retarding forces against the closing force of the throttle valve at the time of quick closing thereof depending on the operating condition of the engine, comprising:

a first diaphragm device consisting of a first diaphragm which is moved in conjunction with the throttle valve when the throttle valve opening is smaller than the specified value, a spring for urging said first diaphragm with a force smaller than the closing force of the throttle valve, and a first diaphragm chamber which is formed in the rear of said first diaphragm and to which atmospheric pressure is admitted; and a second diaphragm device connected to said first diaphragm device, consisting of a second diaphragm having a stopper for controlling the position of said first diaphragm, a spring for urging said second diaphragm with a force larger than the closing force of the throttle valve, and a second diaphragm chamber formed in the rear of said second diaphragm.

4 Claims, 5 Drawing Figures

THROTTLE VALVE OPENING CONTROLLER

BACKGROUND OF THE INVENTION

1. Field of the Invention

The present invention relates to a throttle valve opening controller for applying retarding forces against the closing force of the throttle valve at the time of quick closing thereof. More particularly, this invention relates to an improved throttle valve opening controller, which is suitable for use in internal combustion engines of automobiles equipped with exhaust purifying devices, and is provided with a diaphragm device consisting of a diaphragm which is moved in association with the throttle valve when the opening of said throttle valve is smaller than the predetermined value, a spring for urging said diaphragm with a force smaller than the closing force of the throttle valve, and a diaphragm chamber which is formed in the rear of said diaphragm and to which atmospheric pressure is admitted.

2. Description of the Prior Art

Generally, non-clean exhaust gases from internal combustion engines, such as automobile engines, include hydrocarbons (HC), carbon monoxide (CO), and oxides of nitrogen (NOx). Of these exhaust components, hydrocarbons are formed as a result of incomplete combustion, flame arresting at inner wall surfaces of the combustion chambers or misfire. In particular, when the throttle valve is closed fully and quickly at the time of engine brake application or for any other reasons, the negative pressure in the intake pipe increases abruptly, and therefore the fuel adhering to the intake manifold evaporates quickly and the evaporated fuel is sucked into the combustion chamber of the engine in large quantities. In addition, as the absolute volume of air being sucked becomes insufficient, ignition becomes inferior, resulting in misfire or near-misfire. Under this condition, unburned fuel is discharged as hydrocarbons in large quantities. To prevent the emission of hydrocarbons when the engine brake is applied, deceleration control devices, such as throttle positioner and dash pot, have been proposed. These devices are designed to reduce the formation of hydrocarbons through the improvement of combustion and the prevention of fire suffocation by preventing the air-fuel mixture from becoming too rich and maintaining a certain volume of air-fuel mixture at the time of deceleration.

As shown in FIG. 1, such a device comprises, for example, a diaphragm device 18 which is designed to apply retarding forces against the closing force of a throttle valve 16 disposed downstream of a venturi 14 in an intake passage 12 of a main body of carburetor 10 at the time of quick closing thereof. This diaphragm device consists of a diaphragm 18*a* which is in abutting contact with a throttle valve lever 17 rotatable together with the throttle valve 16 through a rod 24 having an positionally adjustable stopper 25 at the tip thereof and is moved in association with the throttle valve 16, a compression spring 18*c* for biasing said diaphragm 18*a* with a force smaller than the closing force of the throttle valve, and a diaphragm chamber 18*b* which is formed in the rear of said diaphragm 18*a* and to which atmospheric pressure is admitted from an air filter 22 through a vacuum transmitting valve (hereinafter referred to briefly as 'VTV') 20. The VTV 20 has a check valve 20*a* and an orifice 20*b* which are connected to each other in parallel. The check valve 20*a* is arranged in such a direction that the atmospheric pressure admitted from the air filter 22 can be rapidly transmitted to the diaphragm chamber 18*b* of the diaphragm device 18. In FIG. 1, numeral 26 designates an air cleaner for admitting clean air to the intake passage 12, while numeral 28 indicates a intake manifold for distributing and supplying the air-fuel mixture produced in the main body of carburetor 10 to the combustion chambers of the engine.

In conventional deceleration control devices as described above, when the engine is stopped, the force of the return spring of the throttle valve 16 for applying the closing force to said throttle valve 16, which is larger than the force of the compression spring 18*c* of the diaphragm device 18. Accordingly, the rod 24 is pushed back to the right in FIG. 1 by the throttle valve lever 17, overcoming the force of the compression spring 18*c*, thus keeping the throttle valve 16 in the fully closed condition or in the predetermined idling opening. When the engine is operated, the throttle valve 16 is opened in association with the accelerator not shown. Under this condition, the throttle valve lever 17 is disengaged from the stopper 25, and the stopper 25 and the rod 24 are pushed forward to the predetermined position by the actions of the compression spring 18*c* and the air admitted quickly to the diaphragm chamber 18*b* through the air filter 22 and the VTV 20. If the accelerator is suddenly closed at the time of deceleration or for any other reasons and a closing force is applied to the throttle valve 16, the throttle valve 16 is turned in the closing direction by the force of the return spring thereof. When the opening of the throttle valve 16 has been decreased to such an extent where the throttle valve lever 17 reaches the position where it comes into abutting contact with the stopper 25, a retarding force is applied to the throttle valve lever 17 of the throttle valve 16 through the rod 24 and the stopper 25 by the actions of the compression spring 18*c* and the air pressure accumulated in the diaphragm chamber 18*b*. Accordingly, the quick closing of the throttle valve 16 is prevented, and the throttle valve 16 is closed progressively by the force of the return spring of the throttle valve 16 which overcomes the force of the compression spring 18*c* and the air pressure in the diaphragm chamber 18*b*. At this time, the operating characteristic of the diaphragm 18*a* of the diaphragm device 18, i.e., the opening control of the throttle valve 16 is dependent upon the conditions of the air which flows backward toward the air filter 22 from the diaphragm chamber 18*b* of the diaphragm device 18 through the orifice 20*b* of the VTV 20. As the quick closing of the throttle valve 16 is prevented by the diaphragm device 18 as described above, the sudden increase in negative pressure in the intake manifold 28 is prevented and a certain amount of air-fuel mixture is secured. As a result, combustion is improved and misfire is prevented, thus reducing the formation of hydrocarbons.

In internal combustion engines, on the other hand, the opening of the throttle valve to be maintained at the time of deceleration varies with the operating conditions in general. For example, the frictional force to be developed in the internal combustion engine in the cold state differs from that in the warmed-up engine even if the throttle valve opening is the same. Accordingly, the performance of engine brake is varied. And in the internal combustion engines provided with a catalytic converter as an exhaust purifying device in the exhaust system, the formation of hydrocarbons should be reduced by increasing the opening of the throttle valve maintained at the time of deceleration when the engine is in the cold state and a temperature of the catalytic converter has not reached a level at which its purifying performance is fully exhibited. After the engine has been sufficiently warmed up to a temperature level at which the catalytic converter fully performs the purifying performance, it is desirable to leave the reduction of exhaust of hydrocarbons to the catalytic converter and to decrease the throttle valve opening in order to prevent increased fuel cost and improve the engine brake performance, thereby improving the running performance of the vehicle.

In conventional deceleration control devices, however, the operating characteristics of the diaphragm device are the same, regardless of the running conditions of the engine and these devices have a disadvantage that the problems of the running performance of the vehicle, exhaust gas purification and fuel cost are not sufficiently solved either in the cold state or in the warmed-up condition of the engine.

SUMMARY OF THE INVENTION

This invention has been developed to obviate the drawbacks of conventional devices as described above. It is the object of this invention to improve the operating performance of the engine, exhaust gas purifying performance, and fuel cost by providing a throttle valve opening controller which can obtain the most suitable valve opening depending on the operating condition of the engine.

The abovedescribed object has been accomplished by that, according to the present invention, the throttle valve opening controller comprises said diaphragm device consisting of a first diaphragm which is moved in association with the throttle valve when the opening of the throttle valve is smaller than the predetermined value, a spring for biasing said first diaphragm with a force smaller than the closing force of the throttle valve, and a first diaphragm chamber which is formed on the rear side of said first diaphragm and to which atmospheric pressure is admitted, a second diaphragm device connected to said first diaphragm device consisting of a second diaphragm with a stopper for controlling the position of said first diaphragm, a spring for urging said second diaphragm with a force larger than the closing force of the throttle valve, and a second diaphragm chamber formed in the rear of said second diaphragm, thereby applying varied retarding forces against the closing force of the throttle valve depending on the operating condition of the engine through controlling the position of said second diaphragm depending on the operating condition of the engine.

Furthermore, a solenoid valve for admitting atmospheric pressure or the intake vacuum in the intake manifold to the second diaphragm chamber depending on the operating condition of the engine is provided so that said second diaphragm maintains the varying positions depending on the operating condition of the engine.

Moreover, a solenoid change-over valve for admitting the intake vacuum existing directly below the throttle valve in the intake passage to said second diaphragm chamaber directly or through the VTV is provided so that the throttle valve is displaced with varying operating characteristics depending on the running condition of the engine.

BRIEF DESCRIPTION OF THE DRAWINGS

The abovementioned features and objects of the present invention will become more apparent by referring to the following description taken in conjunction with the accompanying drawings, wherein like reference numerals denote like elements, and in which.

DETAILED DESCRIPTION OF THE INVENTION

Figure 1:
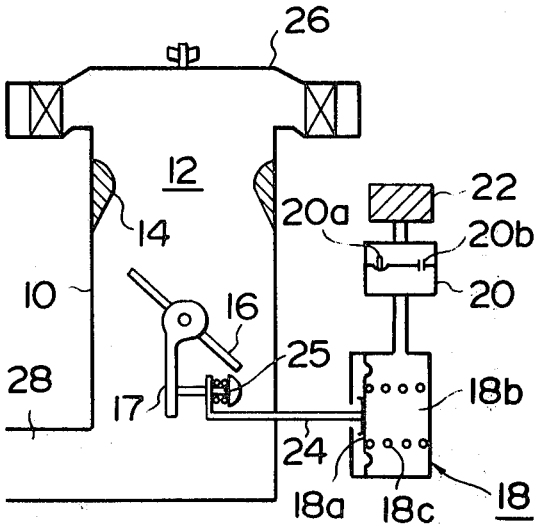
FIG. 1 is a schematic diagram showing an example of the construction of conventional throttle valve opening controller.
Figure 2:
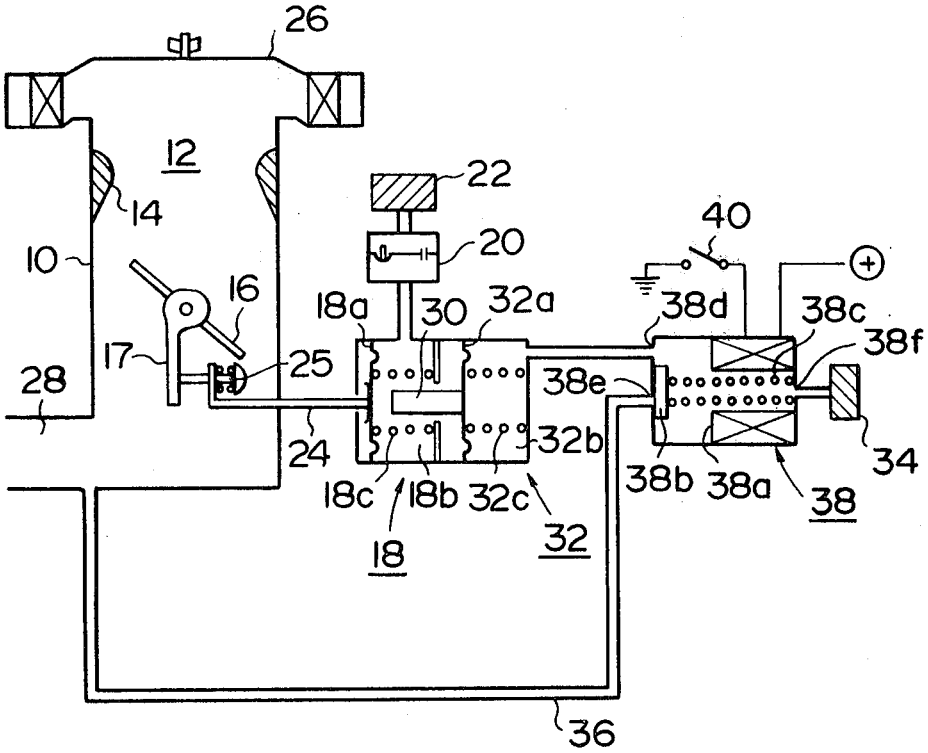
FIG. 2 is a schematic diagram showing the construction of the first embodiment of the throttle valve opening controller according to the present invention.

Embodiments of the present invention will be described in detail with reference to the accompanying drawings. As shown in FIG. 2, the first embodiment of the present invention is of such an arrangement that, in a throttle valve opening control device similar to the conventional one, a first diaphragm device 18 is connected to a second diaphragm 32*a* solidly secured at the substantially central portion thereof with a stopper 30 for regulating the position of a first diaphragm 18*a* of the first diaphragm device 18, a compression spring 32*c* for biasing the second diaphragm 32*a* by a force stronger than a closing force of a throttle valve and a second diaphragm device 32 having a second diaphragm chamber 32*b* provided in the rear of the second diaphragm 32*a*, and a solenoid valve 38 is provided for introducing the atmospheric pressure into said second diaphragm chamber 32*b* through a secondary air filter 34 or the intake vacuum from the intake manifold 28 through a first passage 36 depending on the operating condition of the engine.

The solenoid valve 38 consists of a solenoid 38*a* whose energization is controlled by an operating condition detecting switch 40 which is turned on or off in response to the operating conditions, such a detecting switch for the temperature of engine coolant, a valve body 38*b* which is attracted by said solenoid 38*a* so that a vacuum in the intake manifold 28 is introduced into the second diaphragm chamber 32*b* through a vacuum port 38*e* the first passage 36 the solenoid valve 38, a port 38*d* and a second passage between the second diaphragm chamber 32*b* and the solenoid valve 38 when the solenoid is energized, but so that atmosphere is introduced through the second passage, a vacuum port 38*f* and an air filter 34 when the solenoid is not energized, and a compression spring 38*c* for biasing said valve body 38*b* to the left in FIG. 2.

The operation will hereunder be described. Assuming that the operating condition detecting switch 40 is a water-temperature switch which is operated upon detection of the temperature of engine coolant, this switch issues OFF signals when the temperature of engine coolant is lower than the predetermined value, i. e., the engine is in the cold state, but issues ON signals after the temperature of engine coolant has exceeded the predetermined value, i. e., the engine has been warmed up. So, when the temperature of engine coolant is lower than the predetermined value, i. e., the engine is in the cold state, current is not fed to the solenoid 38*a* of the solenoid valve 38. Accordingly, the valve body 38*b* is kept in the left position in FIG. 2 by the force of the compression spring 38*c*, and the air is introduced from the air filter 34 through the vacuum ports 38*f* and 38*d* and the second passage into the second diaphragm chamber 32*b* of the second diaphragm device 32. Accordingly, the second diaphragm 32*a* of the second diaphragm device 32 is kept in the comparatively leftward position in FIG. 2 by the force of the compression spring 32*c*, and therefore the stopper 30 is also kept in the comparatively leftward position in FIG. 2. So, when the throttle valve 16 is to be quickly closed as a result of the application of engine brake or for any other reasons under this condition, the throttle valve 16 is quickly closed by the actions of the closing spring of the throttle valve 16 until the tip of the throttle valve lever 17 comes into abutting contact with the stopper 25. When the tip of the throttle valve lever 17 has come into abutting contact with the stopper 25, a retarding force is applied against the closing force of the throttle valve 16 by the actions of the air being introduced into the first diaphragm chamber 18*b* of the first diaphragm device 18 through the air filter 22 and the VTV 20 and of the compression spring 18*c*. As the closing force of the throttle valve 16 is larger than the force of the compression spring 18*c*, the throttle valve 16 is closed at a speed slowed down by the actions of the compression spring 18*c* and the atmospheric pressure which is leaking from the first diaphragm chamber 18*b* through the VTV 20. The throttle valve 16 is closed until the first diaphragm 18*a* comes into abutting contact with the stopper 30 which is set in the comparatively leftward position, but is not closed any more, because the force of the compression spring 32*c* which is pushing the stopper 30 and the second diaphragm 32*a* is larger than the closing force of the throttle valve 16. When the engine is in the cold state, therefore, the throttle valve is opened to the specified angle even when the engine brake is applied. Accordingly, the air-fuel mixture in the combustion chamber of the engine does not become excessively rich and the formation of hydrocarbons is prevented, thus making it possible to obtain satisfactory exhaust purifying performance even if the catalytic converter installed in the exhaust system is not functioning effectively.

After the temperature of engine coolant as detected by the operating condition detecting switch 40 has exceeded the predetermined value, i. e., the engine has been sufficiently warmed up, the operating condition detecting switch 40 is closed, and therefore current is fed to the solenoid 38*a* of the solenoid valve 38. Accordingly, the valve body 38*b* is attracted to the right of the FIG. 2, overcoming the force of the compression spring 38*c*, and the intake vacuum in the intake manifold 28 is admitted to the second diaphragm chamber 32*b* of the second diaphragm device 32 through the first passage 36, the second passage and the vacuum ports 38*e* and 38*d*. Accordingly, the second diaphragm 32*a* of the second diaphragm device 32 is attracted to the right in FIG. 2, overcoming the force of the compression spring 32*c*, and consequently the stopper 30 is also displaced to the right in FIG. 2. When the engine brake is applied under this condition, the first diaphragm 18*a* of the first diaphragm device 18 is quickly displaced to the specified right position depending on the force of the compression spring 18*c* and the atmospheric pressure being leaked into the first diaphragm chamber 18*b* through the VTV 20 without being restricted by the stopper 30. Accordingly, the opening of the throttle valve 16 is returned to the idling position in the same manner as in conventional throttle valve opening controllers.

Figure 3:
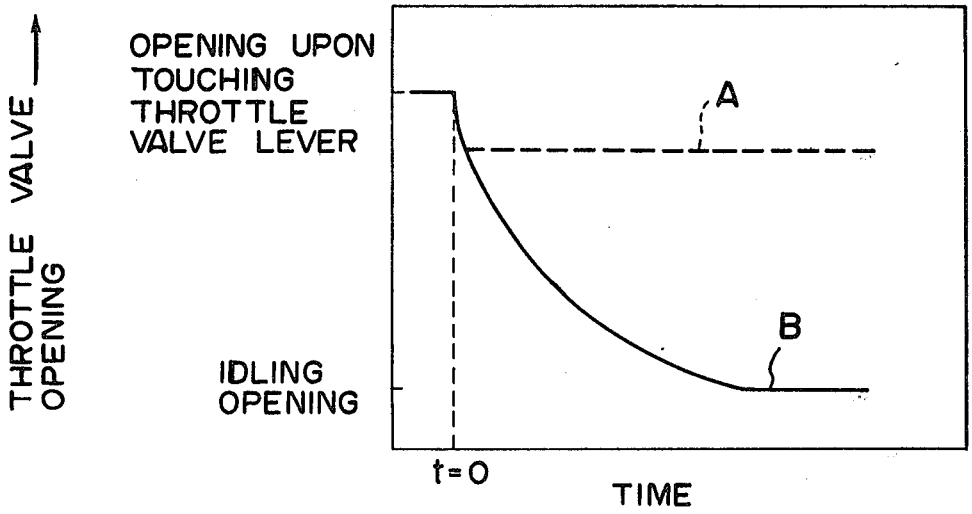
FIG. 3 is a timing diaphragm showing changes in throttle valve opening in the first embodiment.

FIG. 3 shows changes in valve opening characteristics during the abovementioned period. In FIG. 3, the broken line A shows in throttle valve opening in the present embodiment when the engine is in the cold state, while the continuous line B shows changes in throttle valve opening in the present embodiment after the engine has been warmed up.

Figure 4:
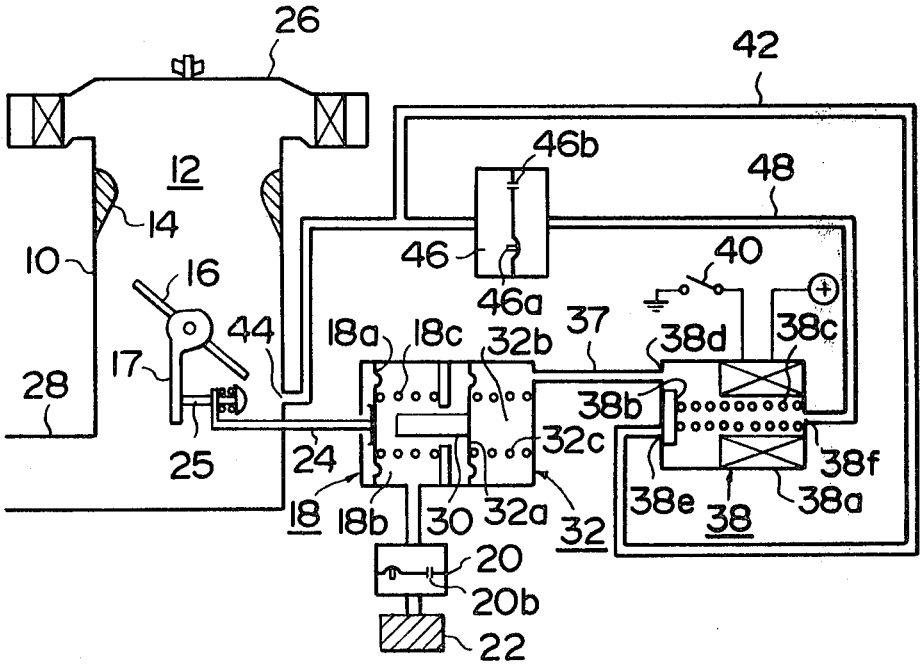
FIG. 4 is a schematic diagram showing the construction of the second embodiment of the throttle valve opening controller according to the present invention.

The second embodiment of the present invention is shown in FIG. 4. The throttle valve opening controller of this embodiment consists of the second diaphragm device 32, the solenoid valve 38 and the operating condition detecting switch 40 in the similar manner as the first embodiment. In this controller, the port 38*e* of the solenoid valve 38 is in direct communication with a vacuum port 44 disposed directly downstream of the throttle valve 16 in the intake passage 12 through a first passage 42, and the port 38*f* of the solenoid valve 38 is in communication with the vacuum port 44 through a third passage 48 having a VTV 46 thereon. The VTV 46 comprises a check valve 46*a* and an orifice 46*b* which are connected to each other in parallel. The check valve 46*a* is arranged in such a direction that the high pressure existing in the vacuum port 44 can be quickly transmitted to the solenoid valve 38. As this embodiment is the same as the first embodiment in other points, further explanation is omitted.

The operation of this embodiment will hereunder be described. When the temperature of engine coolant as detected by the operating condition detecting switch 40 is lower than the predetermined value, i. e., the engine is in the cold state, the operating condition detecting switch 40 is opened and current is not fed to the solenoid 38*a* of the solenoid valve 38. Accordingly, the valve body 38*b* is pressed toward the left of the FIG. 4 by the force of the compressing spring 38*c*. The vacuum existing directly downstream of the throttle valve 16 in the intake passage 12 is introduced into the second diaphragm chamber 32*b* of the second diaphragm device 32 through the vacuum ports 38*d* and 38*f*, the VTV 46, the third passage 48, and the vacuum port 44. When the engine is in the normal operating condition and the throttle valve is sufficiently opened, therefore, a comparatively high pressure which is nearly equal to the pressure existing upstream of the throttle valve 16 is introduced into the second diaphragm chamber 32*b* of the second diaphragm device 32 through the vacuum port 44, the VTV 46, and the vacuum ports 38*f* and 38*d*. Under this condition, the second diaphragm 32*a* and the stopper 30 are kept in the comparatively leftward position of the FIG. 4. When the throttle valve 16 is to be quickly closed as the engine brake is applied under the abovementioned condition, the throttle valve 16 is quickly closed by the closing force being applied thereto until the tip of the throttle valve lever 17 comes into abutting contact with the stopper 25. After the tip of the throttle valve lever 17 has come into abutting contact with the stopper 25, the throttle valve 16 is closed at a closing speed corresponding to the force of the compression spring 18*c* and the atmospheric pressure leaking from the orifice 20*b* of the VTV 20 into the first diaphragm chamber 18*b*, because the closing force of the throttle valve 16 is larger than the force of the compression spring 18*c*. When the first diaphragm 18*a* of the first diaphragm device 18 has been displaced to the right and come into abutting contact with the tip of the stopper 30 fastened to the second diaphragm 32*a* of the second diaphragm device 32, the throttle valve 16 is closed by a certain degree and the intake vacuum is admitted, because the force of the compression spring 32*c* supporting the second diaphragm 32*a* and the stopper 30 is larger than the closing force of the throttle valve 16. Accordingly, the air in the second diaphragm chamber 32*b* of the second diaphragm device 32 is released and the throttle valve 16 is closed in association with the movement of the second diaphragm 32*a* which has been displaced to the right of the FIG. 4 at the speed which is determined by the orifice 46*b* of the VTV 46. The closing speed of the throttle valve 16 by the second diaphragm 32*a* is dependent upon the diameter of the orifice 46*b* of the VTV delay valve 46. As described above, when the engine is in the cold state, the throttle valve 16 is closed comparatively quickly until the first diaphragm 18*a* comes into abutting contact with the stopper 30. After the first diaphragm 18*a* has comes into abutting contact with the stopper 30, the throttle valve 16 is closed progressively in association with the movement of the second diaphragm 32*a* which is relatively slow. Accordingly, the air-fuel mixture in the combustion chambers of the engine does not become excessively rich and the formation of hydrocarbons in the combustion chamber of the engine is prevented. Accordingly, satisfactory purifying performance is obtained even if the catalytic converter is not yet functioning sufficiently.

On the other hand, when the temperature of engine coolant as detected by the operating condition detecting switch 40 has exceeded to predetermined value, i. e., the engine has been warmed up, the operating condition detecting switch 40 is closed and current is fed to the solenoid 38*a* of the solenoid valve 38. Accordingly, the valve body 38*b* is attracted to the right in FIG. 4, overcoming the force of the compression spring 38*c*, and consequently the diaphragm chamber 32*b* of the second diaphragm device 32 is brought into direct communication with the vacuum port 44 through the vacuum ports 38*d* and 38*e* and the first passage 42. Accordingly, an atmospheric pressure or intake vacuum corresponding to the opening of the throttle valve 16 is applied directly to the second diaphragm chamber 32*b*, and the intake vacuum is directly applied when the throttle valve 16 is closed by an angle in excess of the predetermined value. Accordingly, the second diaphragm 32*a* is displaced to the right in FIG. 4, overcoming the force of the compression spring 32*c*, and the throttle valve 16 is closed to the idling position at a comparatively high speed which is dependent mainly upon the displacement of the first diaphragm 18*a* of the first diaphragm device 18. when the engine brake is applied, therefore, satisfactory vehicle operating performance can be ensured and fuel cost can be improved. At this time, hydrocarbons may be formed in somewhat larger quantities, but such formation of hydrocarbons does not pose any problem in exhaust purification as the catalytic converter which has been sufficiently warmed up starts to function by that time.

Figure 5:
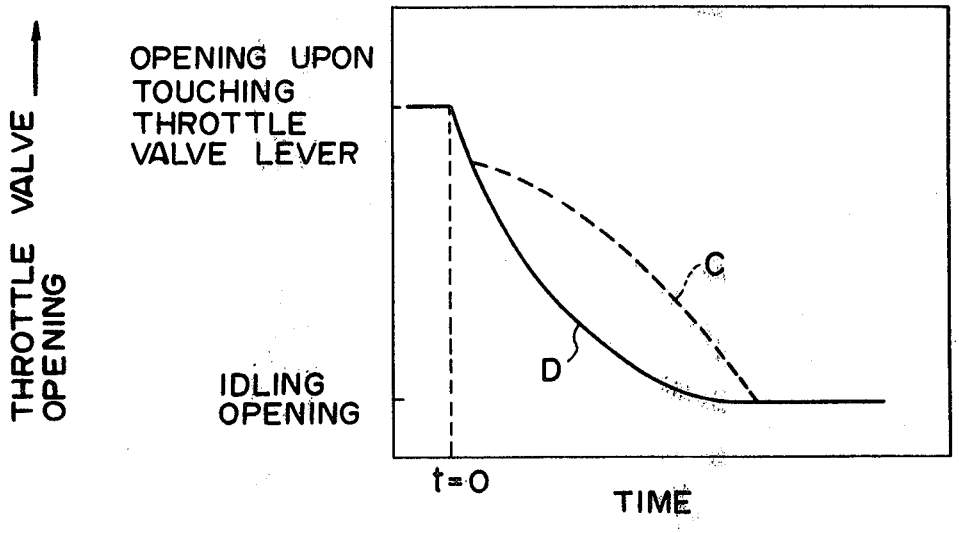
FIG. 5 is a timing diagram showing changes in throttle valve opening characteristics in the second embodiment.

In FIG. 5, changes in throttle valve opening characteristics in this embodiment when the engine is in the cold state are shown by the broken line C, while changes in throttle valve opening after the engine has been warmed up are shown by the continuous line D.

The abovedescribed embodiment are designed so that the operating condition detecting switch detects the temperature of engine coolant and the opening of the throttle valve is controlled depending on the warmed-up condition of the engine. The running condition of the engine according to which the opening of the throttle valve is controlled is not limited to the temperature of engine coolant. It will be possible to detect the warmed-up condition of the engine from the temperature of the engine block, oil temperature, atmospheric temperature, or the time elapsed after engine start, or to control the opening of the throttle valve depending on the shifted position of the transmission or the running speed of the vehicle.

From the foregoing description, if should be apparent to one skilled in the art that the abovedescribed embodiment is but one of many possible specific embodiments which can represent the application of the principles of the present invention. Numerous and varied other arrangements can be readily developed by those skilled in the art without departing from the spirit and scope of the invention.

What is claimed is:

1. A throttle valve opening controller for applying varying retarding forces against closing force of a throttle valve depending on the operating condition of engine, said controller comprising:

a first diaphragm device for applying retarding forces against the closing force of the throttle valve when said valve is to be quickly closed, comprising a first diaphragm which is moved in association with the throttle valve when the throttle valve opening is smaller than a predetermined value, a spring for urging said first diaphragm with a force smaller than the closing force of the throttle valve, and a first diaphragm chamber which is formed on the rear side of said first diaphragm and to which atmospheric pressure is admitted;

a second diaphragm device connected to said first diaphragm device, comprising a second diaphragm having a stopper for controlling the position of said first diaphragm, a spring for urging said second diaphragm with a force larger than the closing force of the throttle valve, and a second diaphragm chamber formed in the rear of said second diaphragm;

a solenoid valve communicated with said second diaphragm chamber and an intake manifold for admitting atmospheric pressure to said second diaphragm chamber when said engine is cool, and intake vacuum in said intake manifold to said second diaphragm chamber when said engine has warmed-up;

said solenoid valve being communicated with said second diaphragm chamber and a portion of said intake manifold directly downstream of the throttle valve for admitting nearly atmospheric pressure to said second diaphragm chamber when said engine is cool, and intake vacuum in said intake manifold to said second diaphragm chamber when said engine has warmed-up;

a first passage directly connected between said solenoid valve and said portion of said intake manifold;

a second passage directly connected between said solenoid valve and said second diaphragm chamber; and a third passage connected between said solenoid valve and said portion of said intake manifold through a transmitting valve.

2. The throttle valve opening controller as set forth in claim 1, wherein said vacuum transmitting valve comprises a check valve and a orifice which are connected to each other in parallel, said check valve being arranged in such a direction that the high pressure existing in the intake passage can be quickly transmitted to the solenoid valve.

3. The throttle valve opening controller as set forth in claim 1, wherein said solenoid valve is controlled by an operating condition detecting switch which is turned on or off depending on the warmed-up condition of the engine.

4. The throttle valve opening controller as set forth in claim 3, wherein said operating condition detecting switch is designed to detect the temperature of engine coolant.

* * * * *